US005496201A

United States Patent [19]

Hwang

[11] Patent Number: 5,496,201

[45] Date of Patent: Mar. 5, 1996

[54] EXTENDABLE EXHAUSTING ASSEMBLY FOR THE MANUFACTURE OF GAS DISCHARGE LAMPS

[75] Inventor: Ching-Hsien Hwang, Hsinchu, Taiwan

[73] Assignee: Industrial Technology Research Institute, Hsinchu, Taiwan

[21] Appl. No.: 261,368

[22] Filed: Jun. 16, 1994

[51] Int. Cl.[6] ..... H01J 9/38

[52] U.S. Cl. ..... 445/38; 445/53; 445/73

[58] Field of Search ..... 445/9, 38, 53, 445/70, 73

[56] References Cited

U.S. PATENT DOCUMENTS

| | | | |
|---|---|---|---|
| 3,484,146 | 12/1969 | Meijer et al. | 445/53 |
| 3,572,877 | 3/1971 | Ogawa et al. | 445/70 |
| 4,364,617 | 12/1982 | Moriwaki et al. | 445/53 |
| 4,993,981 | 2/1991 | Ose et al. | 445/9 |

FOREIGN PATENT DOCUMENTS

| | | | |
|---|---|---|---|
| 48-13437 | 4/1973 | Japan | 445/53 |
| 55-49837 | 4/1980 | Japan | 445/53 |
| 60-37634 | 2/1985 | Japan | 445/38 |
| 3-171524 | 7/1991 | Japan | 445/53 |

*Primary Examiner*—P. Austin Bradley
*Assistant Examiner*—Jeffrey T. Knapp
*Attorney, Agent, or Firm*—W. Wayne Liauh

[57] ABSTRACT

An apparatus and method for the manufacturing of metal salt gas discharge lamps involves a purging assembly which will allow the purging step to be conducted outside a dry box, while completely shielding the fiber material from possible exposure to the atmosphere, so as to simplify the manufacturing process and reduce operation cost. The purging assembly comprises a manifold, which is removably connected to a vacuum pump and an inert gas supply, respectively. The manifold is provided with a plurality of branch tubes connected thereto. Each of the branch tubes is adapted to be connected to a lamp envelope via a ball valve, which provides a straight passage way therethrough when opened. During the purging operations, the ball valves respectively connecting the lamp envelopes and the branch tubes are open to thereby allow moisture and other undesirable components to be purged from the lamp envelope. After the completion of the purging operation, the ball valves are closed and the manifold, with the lamp envelopes attached thereto, is disconnected from the vacuum pump and the inner gas supply and transferred into a glove box. There, the ball valves are opened and the fiber materials are allowed to enter the lamp envelopes. After the filling operation is completed, the ball valves are closed and the manifold is taken out of the glove box. Finally, the manifold is reconnected to the inert gas supply to fill the lamp envelops with inert before the lamp envelopes are sealed and severed.

17 Claims, 4 Drawing Sheets

EXTENDABLE EXHAUSTING ASSEMBLY FOR THE MANUFACTURE OF GAS DISCHARGE LAMPS

FIELD OF THE INVENTION

This invention relates to an apparatus and method for manufacturing gas discharge lamps or tubes containing an inert gas and one or more metal salt fillers sealed therein. More specifically, the present invention relates to an apparatus and method for the manufacture of metal salt, or more particularly metal halide, gas discharge lamps which comprises an extendable gas purging assembly so as to prevent the metal halide fillers from absorbing moisture or to keep them from exposing to the atmosphere during the manufacturing steps of the metal halide lamps.

BACKGROUND OF THE INVENTION

Gas discharge lamps typically contain, in addition to an inert gas, a small quantity of metal salt fillers such as metal halide fillers. Generally, metals such as thallium, sodium, indium and the like can be filled in the form of metal salts in a high pressure mercury discharge lamp to improve light emission efficiency, color rendition and the like. These metal salts have a strong tendency to absorb moisture when exposed to the atmosphere. If, during the manufacture of gas discharge lamps, the moisture is inadvertently admitted into the lamp envelopes, the characteristics of the lamps will be greatly impaired. For example thallium iodide will liquify after exposure to the atmosphere for less than one hour. The weight of thallium iodide will also increase upon exposure to the atmosphere (1% alter three minutes), indicating the great tendency for thallium iodide to absorb moisture. Such a contamination not only causes the discharge lamp to blackened, it also results in an increase in the starting voltage. For example, it has been reported in the literature (Japanese Patent Publication 43-17797) that if the discharge lamp was filled with contaminated thallium iodide, the discharge voltage increased to 350 V; whereas, the consequence was even worse for contaminated sodium iodide. In the latter case, the discharge voltage was increased to 450 V. Therefore, it is critically important during the manufacture of metal halide lamps to thoroughly purge the lamp envelope before charging the metal halide fillers to thus prevent the metal halide fillers from absorbing moisture or to keep them from being exposed to the atmosphere.

A conventional prior art apparatus for manufacturing discharge lamps is described in U.S. Pat. No. 3,572,877, in which it is disclosed a glass envelope mounted with electrodes and adapted to form a discharge lamp is connected to one end of an evacuating pipe system made of glass via a first chipoff portion. Two paced apart branch pipes are connected to the evacuating pipe system. The first branch pipe contains the metal halide filler and the second branch pipe contains mercury. The other end of the evacuating pipe system is connected to a vacuum pump and to a source of inert gas to be filled in via a second chipoff portion. The entire system is first evacuated to a high vacuum by the vacuum pump. After the inert gas is admitted under a desired pressure into the envelope, the first chipoff portion is sealed off and then the envelope and the two branch pipes are separated from the remainder of the system. The separated portions, the envelope and the two branch pipes, are then slanted to allow the metal halide filler and mercury contained in the branch pipe to be transferred to the lamp envelope. Thereafter, the second chipoff portion is sealed off and the envelope is separated from the evacuating system, thus completing the manufacture of a metal halide discharge lamp. The content disclosed in the '877 patent is expressly incorporated herein by reference.

The conventional apparatus has several drawbacks, for example: (1) since the metal halide filler and mercury are contained in the same evacuating system, it is difficult to achieve high vacuum; (2) the metal halide filler tends to decompose thus causing non-uniform quality; (3) deposited moisture is difficult to remove; and (4) provisions of the branch pipes for exhausting of each discharge lamp complicates the manufacturing process as well as the construction of the evacuating system.

A number of improvements have been disclosed in the prior art references. For example, the '877 patent disclosed a manifold connected to both the lamp envelope and the vacuum pump and the inner gas supply, and the use of a capsule which contains the metal halide filler. The capsule is carded via a spindle, which is inserted into the manifold after the purging steps to introduce the metal halide filler to the lamp envelope. This method is cumbersome. Furthermore, because there is no provision to isolate the metal halide filler after the purging step, the spindle must be inserted into the manifold against the flow of the inert gas, or the entire operation must be conducted in a dry box environment. Other improved apparatuses or methods, such as those disclosed in U.S. Pat. No. 4,993,981, Japanese Patent Publications Nos. 40-19548, 43-17787, 43-17797, and 46-19390, all suffer similar problems.

The need to use a dry box for the entire duration of the manufacturing steps, including the purging step, complicates the manufacturing process and increases the manufacturing cost. Furthermore, it is difficult to achieve the desired degree of vacuum in a dry box when the dry box has to accommodate all the piping and valving needs, and the manufacturing operation cannot be easily expanded once it is constructed. Yet furthermore, with the methods and apparatuses disclosed in the prior art, only one discharge tube can be produced per operation; this does not indicate an favorable efficiency.

SUMMARY OF THE INVENTION

Having discussed the shortcomings of prior art apparatuses and methods in the manufacturing of metal salt gas discharge lamps, the primary object of the present invention is to provide an improved apparatus and method for the manufacturing of metal salt gas discharge lamps that will simplify the manufacturing process and reduce operation cost. More specifically, the primary object of the present invention is to provide an improved apparatus and method for the manufacturing of metal halide discharge lamps that will allow the purging step thereof to be conducted outside the dry box, while completely shielding the filler material from possible exposure to the atmosphere, so as to simplify the manufacturing process and reduce operation cost. With the apparatus disclosed in the present invention, a plurality of discharge lamps can be produced per operation; thus greatly enhancing the efficiency of the manufacturing process.

The apparatus disclosed in the present invention comprises a manifold, which is removably connected to a vacuum pump and an inert gas supply, respectively. The manifold is provided with a plurality of branch tubes connected thereto. Each of the branch tube is adapted to be connected to a lamp envelope via a valve, preferably a ball valve with a straight passage way therethrough when opened. The valve can be opened to allow the lamp envelope to be in communication with the manifold, and closed to shield the lamp envelope from the atmosphere. The manifold is connected to the vacuum pump and the inert gas supply via a pair of detachable joints, respectively, so as to allow the manifold to be connected and disconnected with respect to the vacuum pump and the inert gas supply.

During the purging operations, the manifold is alternatively connected to the vacuum pump and the inert gas supply, and the valve connecting the lamp envelope and the branch tube is open to thereby purge the moisture and other undesirable components residing in the lamp envelope. After the completion of the purging operation, the valves to the lamp envelopes are dosed and the manifold, with the lamp envelopes attached thereto, is disconnected from the vacuum pump and the inner gas supply and transferred into a dry box, or a glove box. There, the valves are opened and metal halide and other desired filler materials are allowed to enter the lamp envelopes. After the filling operation is completed, the valves are closed and the manifold is taken out of the glove box. Finally, the lamp envelopes can be sealed off to form discharge lamps containing the metal halide fillers. Or the manifold can be re-connected to the inner gas supply to fill the lamp envelopes with inert gas to a predetermined pressure, before the lamp envelopes are sealed.

Since the present invention allows the purging operation to be conducted outside the glove box without risking the filler material to be contaminated by moisture, the manufacturing process of metal halide discharge lamps is greatly simplified. With the apparatus and method disclosed in the present invention, the problems associated with the need to provide valving and piping assembly for the connection with the vacuum pump and the inert gas supply out of the glove box are eliminated, and the glove box can be more efficiently utilized. Furthermore, a plurality of branch tubes can be connected to the manifold, rims allowing more than one discharge lamp to be manufactured in a single operation. This advantage greatly enhances the economic efficiency in manufacturing discharge lamps.

BRIEF DESCRIPTION OF THE DRAWINGS

The present invention will be described in detail with reference to the drawing showing the preferred embodiment of the present invention, wherein.

DETAILED DESCRIPTION OF THE PREFERRED EMBODIMENT

The present invention will now be described more specifically with reference to the following example. It is to be noted that the following descriptions of example including preferred embodiment of this invention are presented herein for purpose of illustration and description; it is not intended to be exhaustive or to limit the invention to the precise form disclosed.

Figure 1:
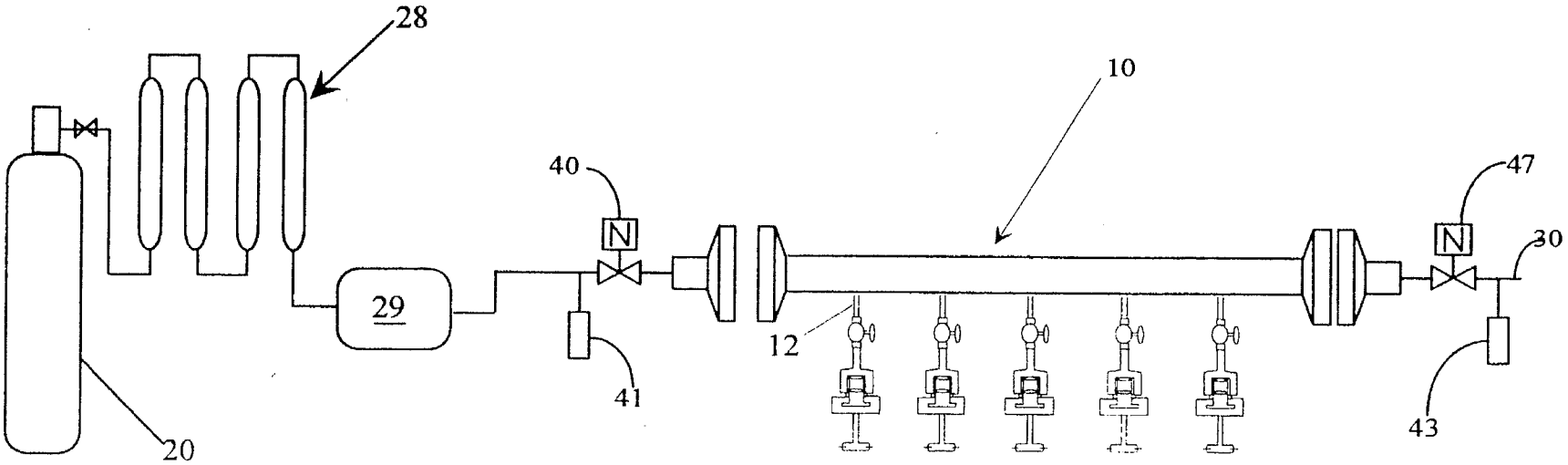
FIG. 1 is schematic diagram showing a preferred embodiment of the present invention containing a purging assembly connected to a vacuum pump and an inert gas supply, respectively.

Now referring to the drawings. FIG. 1 is schematic diagram showing a preferred embodiment of the present invention containing a purging assembly, which comprises a manifold 11 and is connected to a vacuum piping system 30, which is connected to a vacuum pump (not shown), and an inert gas supply 20, respectively. The manifold 11 serves two purposes. First, it purges a lamp envelope before filling in a metal halide filler so that the metal halide filler will not be contaminated with moisture or other undesired components. Second, after the metal halide is added into the lamp envelope, the manifold allows an inert gas to fill into the envelope before it is sealed off so as to protect the filler material. FIG. I shows an inert gas supply 20, from which an inert flows through a purification assembly 28, which is typically in the form of packed cylinders, a moisture and oxygen monitor 29, to an inert gas valve 40. The inert gas valve 40 is connected to a pressure gage 41 then to a first detachable joint 16. The other end of the first detachable joint 16 is connected to the manifold 11, which is provided with a plurality of branch tubes 12. The branch tube is connected to a purging connector 70 via a ball valve 60. The manifold 11 is also connected to a vacuum piping system 30 via a second detachable joint 20, at the other end thereof.

Figure 2A:
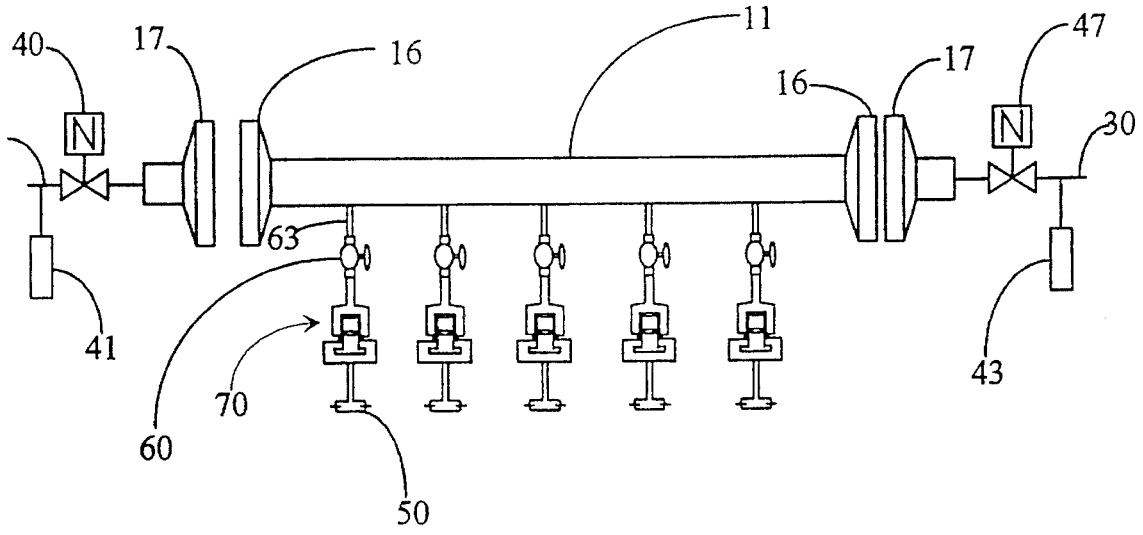
FIG. 2A and FIG. 2B are more detailed descriptions of the various components of the manifold as shown in FIG. 1.
Figure 2B:
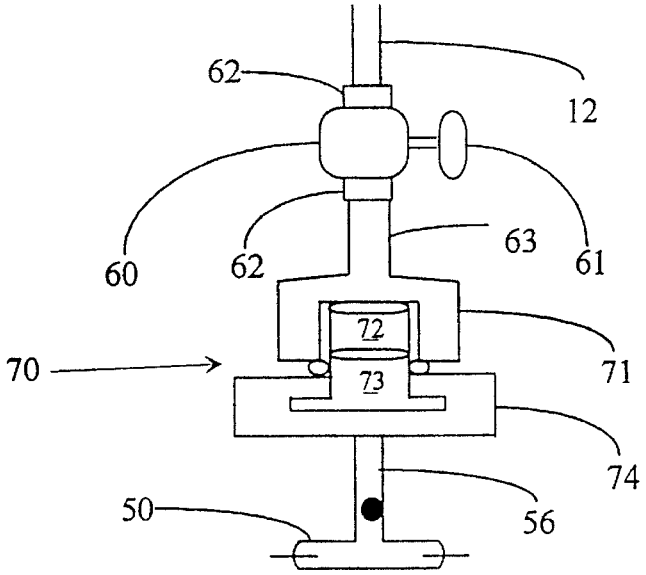

FIG. 2A and FIG. 2B show more detailed descriptions of the various components of the manifold as shown in FIG. 1. The ball valve 60 comprises a valve stem 61 to control the on-off thereof, a pair of thread means 62, which allow the ball valve 60 to be connected to connecting tubes 63. The purging connector 70 comprises an outer sleeve 71, a resilient silicone rubber stopper 72, a pressure adjusting cushing 73, and a purging clamp 74. The purging connector 70 is adapted to be connected to a lamp envelope via a purging tube 56. The inert gas valve 40 is preferably a needle valve and is controlled by a valve stem 43. A vacuum valve 46, also preferably a needle valve, controls the connection between the purging assembly 10 and the vacuum piping system 30. A vacuum gage 47 is provided with the vacuum piping system 30.

Before the purging operation, the flange portions of the detachable joints 16 and 17 are joined together to connect the manifold 11 with the inert gas supply 20 and the vacuum piping system 30, respectively. Lamp envelopes 50 are then respectively affixed to the purging connectors 70. Thereafter, the ball valves 60 and the vacuum valve 46 are opened to evacuate the lamp envelope 50. After evacuation, the vacuum valve 46 is closed and the inner gas valve 40 is opened to allow the inner gas, which is purified by the purification assembly 28, entering the lamp envelope 50 and purge moisture and other undesirable components. If necessary, an electric voltage can be applied to the electrodes (not shown) in the lamp envelope 50 trader vacuum to purge impurity from the electrodes. At the end of the purging operation, the pressure of the inert gas supply is adjusted so that the pressure in the lamp envelope is dose to the atmospheric pressure. Finally, the ball valve 60, vacuum valve 46 and inner gas valve 40 are all closed, and the detachable joints 16 and 17 are detached such that the purging assembly 10 is isolated.

Figure 3:
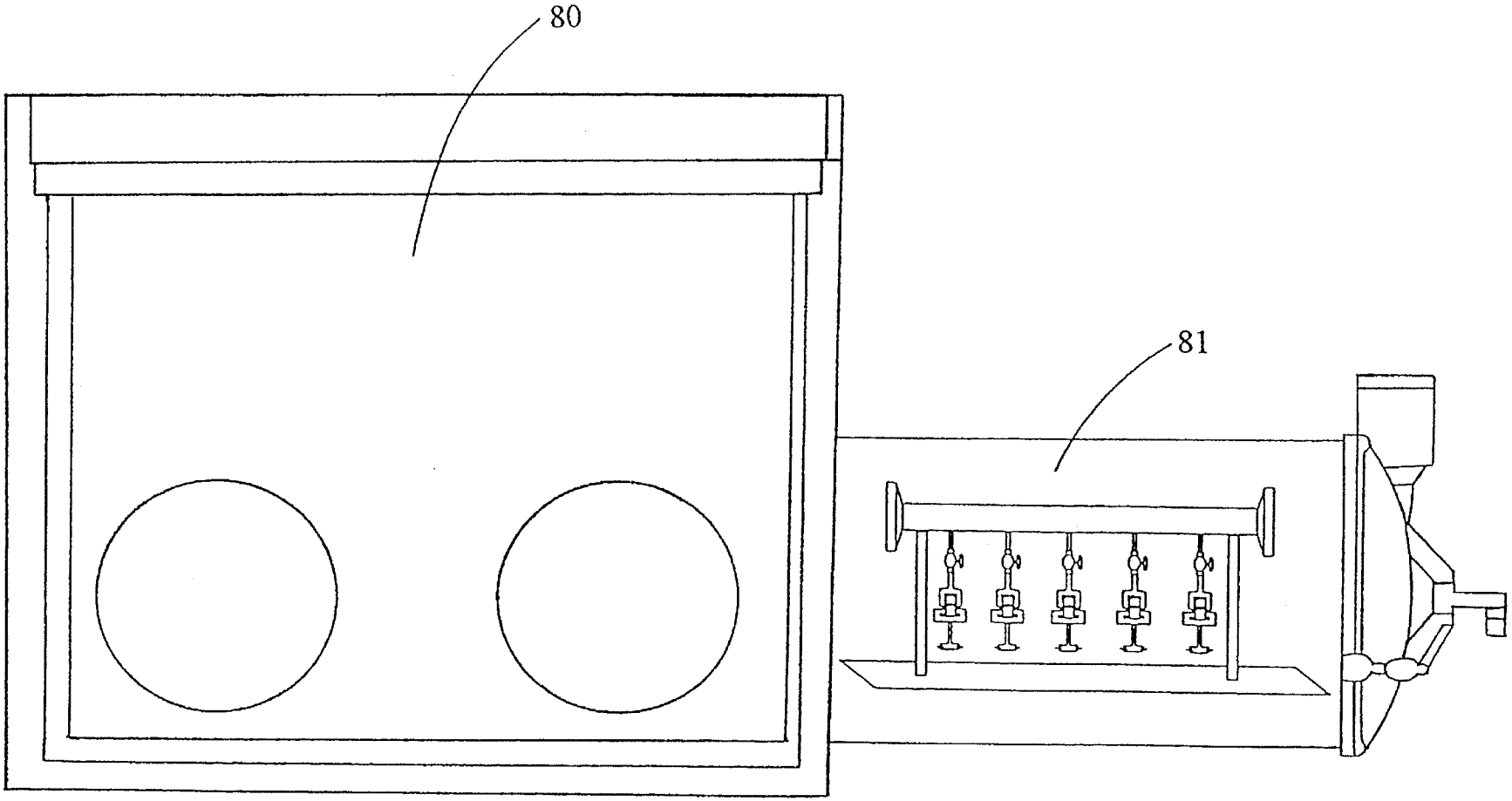
FIG. 3 shows the placement of the manifold, after it being disconnected from the vacuum pump and the inert gas supply, into a glove box.
Figure 4:
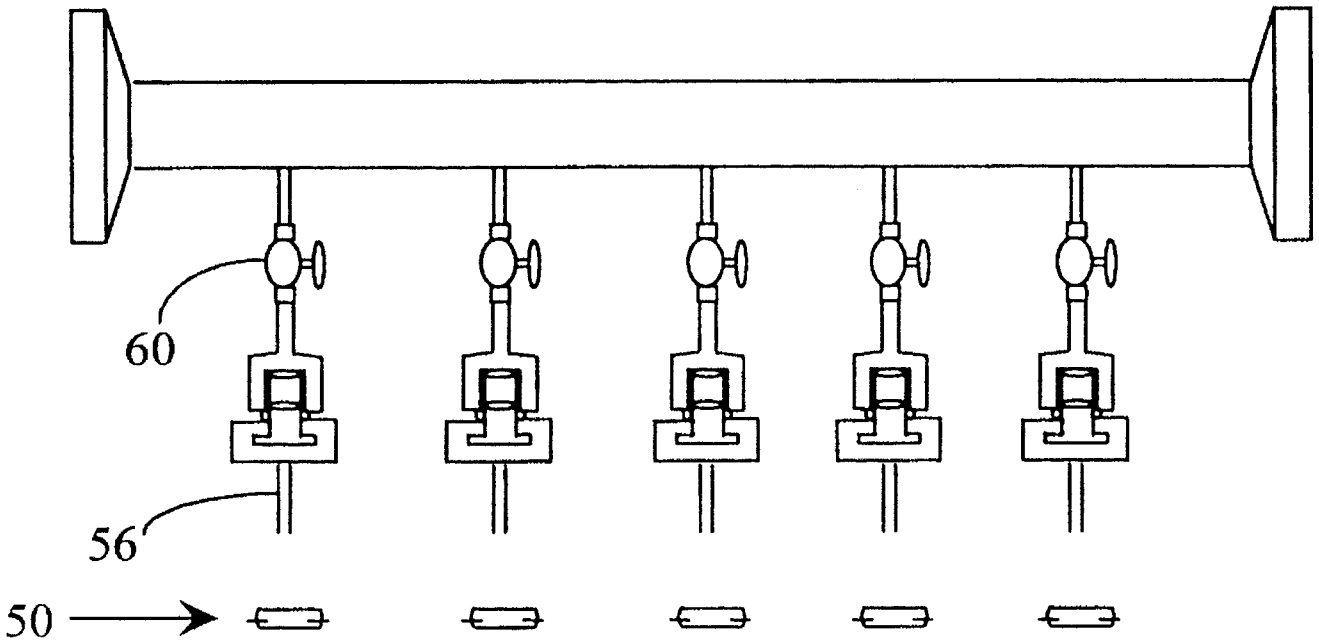
FIG. 4 illustrates the discharge lamps being severed from the purging assembly after the completion of the manufacturing process.

Now referring to FIG. 3. The purging assembly 10, with the purged lamp envelopes 50 attached thereto, is then transferred to a glove box 80 via a treatment chamber 81. Because the ball valves 60 are closed and thus the lamp envelopes 50 are in a sealed environment, the filler material will not be exposed to the atmosphere during the transfer process. Because the glove box 80 also provides a sealed environment, the ball valves 60 can be opened when placed inside the glove box 80 and the filler materials will not risk being exposed to the atmosphere. There are several options to fill the filler material into the lamp envelopes. These methods are well documented in the art, for example, U.S. Pat. Nos. 3,572,877 and 4,993,981, which are incorporated by reference; therefore, they will not be repeated here. After of the completion of the filling operation, the ball valves 60 are closed and the purging assembly 10 is removed from the glove box 80. The purging assembly 10 is reconnected to the inert gas supply 20 to allow inert gas to enter the lamp envelopes 50 until it reaches a predetermined pressure. Finally, the ball valves 60 are closed and the discharge lamps are severed from the purging tube 56 as shown in FIG. 4. The purging tube 56 can be provided with a conventional chipoff portion to facilitate an easy severance of the finished discharge lamp. With the present invention, because the purging operation is conducted outside the glove box 80, the manufacturing procedure and the required piping system are greatly simplified. The present invention also allows a multiplicity of lamp envelopes to be purged and filled with metal halide fillers; thus the present invention greatly enhances the efficiency of the manufacturing process.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A purging assembly for the manufacturing of gas discharge lamps containing a filler material sealed in a lamp envelope comprising:

(a) a manifold having first and second ends for connection to an inert gas supply piping system and a vacuum piping system, respectively;

(b) a branch tube connected to and in communication with said manifold;

(c) a purging connector for receiving said lamp envelope; and (d) a filler valve connected between said branch tube and said purging connector so as to shield said lamp envelope from atmosphere when closed and allow a filler material to travel therethrough when opened, wherein said manifold is connected to said inert gas supply and said vacuum piping system via a pair of detachable joints, respectively, and each of said detachable joints comprises a pair of matching flanges.

2. The purging assembly for the manufacturing of gas discharge lamps according to claim 1 wherein said filler valve is a ball valve which provides a straight through passage way when fully opened.

3. The purging assembly for the manufacturing of gas discharge lamps according to claim 1 wherein said purging connector comprises an outer sleeve, a resilient stopper, a pressure adjusting cushing, and a clamp.

4. The purging assembly for the manufacturing of gas discharge lamps according to claim 1 wherein said filler material is a metal halide.

5. The purging assembly for the manufacturing of gas discharge lamps according to claim 1 wherein said filler material is a halide of thallium, sodium, and indium.

6. The purging assembly for the manufacturing of gas discharge lamps according to claim 1 which comprises a plurality of branch tubes and an equal number of purging connectors for manufacturing a plurality of gas discharge lamps.

7. The purging assembly for the manufacturing of gas discharge lamps according to claim 6 which comprises at least five branch tubes and the same number of purging connectors for manufacturing at least five discharge lamp.

8. A method for the manufacturing of gas discharge lamps containing a filler material sealed in a lamp envelope comprising the steps of:

(a) obtaining a purging assembly comprising:

(I) a manifold having first and second ends for connection to an inert gas supply piping system and a vacuum piping system, respectively, wherein said inert gas supply piping system containing a gas supply valve and said vacuum piping system containing a vacuum valve;

(ii) a branch tube connected to and in communication with said manifold;

(iii) a purging connector for receiving said lamp envelope; and (iv) a filler valve connected between said branch tube and said purging connector so as to shield said lamp envelope from atmosphere when closed and allow said filler material to travel therethrough when opened.

(b) connecting a lamp envelope to said purging connector;

(c) connecting said purging assembly to an inert gas supply and a vacuum pump at said first and second ends, respectively;

(d) closing said gas supply valve and opening said vacuum valve to evacuate said lamp envelope;

(e) closing said vacuum valve and opening said gas supply valve to force an inert gas into said lamp envelope from an inert gas supply;

(f) closing said filler valve to seal said lamp envelope from atmosphere;

(g) placing said purging assembly with said lamp envelope attached thereto inside a glove box in an inert environment:

(h) opening said filler valve to allow a predetermined amount of a filler material to enter said lamp envelope;

(I) closing said filler valve and removing said purging assembly with said lamp envelope attached thereto from said glove box;

(j) connecting said purging assembly to said inert gas supply until said lamp envelope reaches a predetermined pressure; and (k) sealing off said lamp envelope to form a discharge lamp and disconnecting said discharge lamp from said purging connector.

9. A method for the manufacturing of gas discharge lamps according to claim 8 wherein a filler valve is a ball valve which provides a straight through passage way when fully opened.

10. A method for the manufacturing of gas discharge lamps according to claim 8 wherein said purging connector comprises an outer sleeve, a resilient stopper, a pressure adjusting cushing, and a clamp.

11. A method for the manufacturing of gas discharge lamps according to claim 8 wherein said filler material is a metal halide.

12. A method for the manufacturing of gas discharge lamps according to claim 8 wherein said filler material is a halide of thallium, sodium, or indium.

13. A method for the manufacturing of gas discharge lamps according to claim 8 wherein said lamp envelope is connected to said purging connector via a purging tube having a chipoff portion.

14. A method for the manufacturing of gas discharge lamps according to claim 8 which comprises a plurality of branch tubes and an equal number of purging connectors for manufacturing a plurality of gas discharge lamps, and said step (b) being the step of connecting a plurality of lamp envelopes to said purging connectors, respectively.

15. A method for the manufacturing of gas discharge lamps according to claim 14 which comprises at least five branch tubes and at least five purging connectors for manufacturing at least five gas discharge lamps, and said step (b) being the step of connecting at least five lamp envelopes to said equal number of purging connectors, respectively.

16. A method for the manufacturing of gas discharge lamps according to claim 8 wherein said manifold is connected to said inert gas supply and said vacuum piping system via a pair of detachable joints, respectively.

17. A method for the manufacturing of gas discharge lamps according to claim 16 wherein each of said detachable joints comprises a pair of matching flanges.

* * * * *